US010054362B2

(12) United States Patent
Chang et al.

(10) Patent No.: US 10,054,362 B2
(45) Date of Patent: Aug. 21, 2018

(54) REFRIGERATOR

(71) Applicant: LG ELECTRONICS INC., Seoul (KR)

(72) Inventors: Jinho Chang, Seoul (KR); Hyungkyu Park, Seoul (KR); Dongjeong Kim, Seoul (KR); Changgeun Lee, Seoul (KR); Ayeong Lee, Seoul (KR); Jungjae Lee, Seoul (KR); Jaehoon Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/531,009

(22) PCT Filed: Jul. 29, 2016

(86) PCT No.: PCT/KR2016/008418
§ 371 (c)(1),
(2) Date: May 26, 2017

(87) PCT Pub. No.: WO2017/018865
PCT Pub. Date: Feb. 2, 2017

(65) Prior Publication Data

US 2017/0336132 A1 Nov. 23, 2017

(30) Foreign Application Priority Data

Jul. 30, 2015 (KR) ..... 10-2015-0108162
Jul. 30, 2015 (KR) ..... 10-2015-0108163
Aug. 19, 2015 (KR) ..... 10-2015-0116622

(51) Int. Cl.
*F25D 23/00* (2006.01)
*F25D 23/02* (2006.01)
(Continued)

(52) U.S. Cl.
CPC ..... *F25D 23/028* (2013.01); *E05F 15/619* (2015.01); *F25D 11/02* (2013.01);
(Continued)

(58) Field of Classification Search
CPC ..... F25D 23/02; F25D 23/028; F25D 2323/02
See application file for complete search history.

(56) References Cited

U.S. PATENT DOCUMENTS 5,469,469 A * 11/1995 Haines ..... H04B 1/69 375/131
6,338,536 B1 * 1/2002 Ueno ..... E05B 17/0033 312/405
(Continued)

FOREIGN PATENT DOCUMENTS

EP 2010-0264677 1/2010
JP 2001-055863 2/2001
(Continued)

OTHER PUBLICATIONS

Extended European Search Report in European Application No. 16801365.4, dated Jan. 5, 2018, 9 pages (with English translation).

*Primary Examiner* — Daniel J Rohrhoff
(74) *Attorney, Agent, or Firm* — Fish & Richardson P.C.

(57) ABSTRACT

The present invention relates to a refrigerator. A refrigerator according to an aspect includes a cabinet in which a storage compartment is formed; a first refrigerator door which is capable of opening and closing the storage compartment; second refrigerator door which is disposed along with the first refrigerator door in a lateral direction; and a door opening device which is capable of operating in order to open and close at least one of the first refrigerator door and the second refrigerator door, wherein the door opening device includes a motor for generating a driving force; a push rod which operates by receiving the driving force
(Continued)

generating from the motor; a gear for transferring the driving force of the motor to the push rod.

7 Claims, 17 Drawing Sheets

(51) Int. Cl.
*F25D 11/02* (2006.01)
*E05F 15/619* (2015.01)

(52) U.S. Cl.
CPC ..... *F25D 23/02* (2013.01); *E05Y 2900/31* (2013.01); *F25D 2323/021* (2013.01); *F25D 2323/024* (2013.01); *F25D 2700/02* (2013.01)

(56) References Cited

U.S. PATENT DOCUMENTS 7,496,939 B2 * 2/2009 Guo ..... F16H 35/10 720/664
2008/0083243 A1 * 4/2008 Lee ..... F25D 23/028 62/446
2010/0264677 A1 10/2010 Denison et al.
2013/0113357 A1 5/2013 Park et al.
2015/0338156 A1 * 11/2015 Held ..... F25D 23/028 312/405
2017/0097185 A1 * 4/2017 Yasaka ..... E05F 15/614
2017/0260794 A1 * 9/2017 Son ..... E05F 15/614

FOREIGN PATENT DOCUMENTS

JP 2015-055437 3/2015
KR 10-2010-0022654 3/2010
KR 10-2011-0040030 4/2011
WO 2016-036212 3/2016
WO 2016-036213 3/2016

* cited by examiner

REFRIGERATOR

CROSS REFERENCE TO RELATED APPLICATIONS

This application is a U.S. National Phase Application under 35 U.S.C. § 371 of International Application PCT/KR2016/008418, filed on Jul. 29, 2016, which claims the benefit of Korean Application No. 10-2015-0108162, filed on Jul. 30, 2015, Korean Application No. 10-2015-0108163, filed on Jul. 30, 2015, and Korean Application No. 10-2015-0116622, filed on Aug. 19, 2015, the entire contents of which are hereby incorporated by reference in their entireties.

TECHNICAL FIELD

The present invention relates to a refrigerator.

BACKGROUND ART

Generally, the refrigerator is a household appliance that allows food to be stored at low temperatures in an internal storage compartment that is shielded by a door.

A method for opening door of a refrigerator is disclosed in the Korean Patent. Publication No. 2011-0040030 (Published date: Apr. 20, 2011) which is the prior art).

In the prior art, the doors are disposed to be spaced apart from each other in the lateral direction. A door handle is provided in the refrigerator door. An operating portion is provided in the door handle. A door opening device is also provided in a cabinet which forms a storage space.

When a user operates the operating portion, the door opening device pushes the door and thus opens the door.

However, in a case of the prior art, in a state a door of the refrigerator is opened from the door opening device, since a rear surface of the opened door of the refrigerator is positioned at a rear side of front surface of the closed door of the refrigerator and thus a gap between two doors of the refrigerator is not enough, in a case both hands of the user are not free since the user holds food or things, it is difficult to increase an opening angle of the door of the opened refrigerator using feet or elbow other than both hands.

In a case of the prior art, user pulls out the door handle in a state where the user is holding the food or object on the floor, even one refrigerator door is opened.

DISCLOSURE OF THE INVENTION

Technical Problem

An objective of the present invention is to provide a refrigerator which is capable of easily increasing an opening angle of the opened refrigerator door even in a case where both hands of a user are not free since the user holds food or things.

Technical Solution

A refrigerator according to a first aspect includes a cabinet which forms a storage compartment; a first refrigerator door which is capable of opening and closing the storage compartment; a second refrigerator door which is disposed along with the first refrigerator door in the lateral direction; and a door opening device which is capable of operating in order to open and close at least one of the first refrigerator door and the second refrigerator door.

The door opening device includes a motor for generating a driving force; a push rod which operates by receiving the driving force generated from the motor; and a gear for transferring the driving force of the motor to the push rod.

In a case the motor operates for opening of one refrigerator door of the first refrigerator door and the second refrigerator door, the push rod moves a door opening position from an initial position and in a state the push rod is moved to the door opening position, at least a portion of the rear surface of the door is positioned to the front side than the front surface of the refrigerator door of the first refrigerator door and the second refrigerator door.

The door opening device may be provided to one refrigerator door.

The door opening device may be positioned on the upper side portion of one refrigerator door.

In a process of the push rod moving to the door opening position from the initial position, the push rod may be in contact with the front surface of the cabinet.

In a process of the push rod moving to the door opening position from the initial position, the push rod may maintain a state of being in contact with a point of the front surface of the cabinet.

The push rod may engage with the gear and may include a rack gear having a curved shape.

The rack gear may be formed as an arc shape.

The center of the rack gear having the arc shape may be a center of the hinge shaft of the one refrigerator door.

The one refrigerator door includes a first side surface and a second side surface facing the first side surface, the second side surface is a surface which is adjacent to other refrigerator door of the first refrigerator door and the second refrigerator door and the hinge shaft of the one refrigerator door and the push rod may be positioned in the area which corresponds to between an virtual line which bisects an interval between the first side surface and the second side surface and the first side surface.

The push rod may be positioned on an area between the virtual line and the hinge shaft.

Advantage of the Invention

According to the proposed invention, in a state one refrigerator door is opened, at least a portion of the rear surface of the one refrigerator door may be positioned on the front side of the front surface of the closed other refrigerator door. Accordingly, in a state where the one refrigerator door is opened, a gap may be formed between a rear surface of the one refrigerator door and the front surface of the other refrigerator door. Therefore, the present invention has an advantage of increasing the opening angle of the one refrigerator door using an elbow, feet, or the like even in the case a person holds food or things.

At this time, in a case of the present invention, the push rod includes a rack gear having a curved shape and is positioned to be close to the hinge shaft which provides a rotating center of the door and thus the opening angle of the refrigerator door may be increased while the length of the push rod reduced.

MODE FOR THE INVENTION

Figure 1:
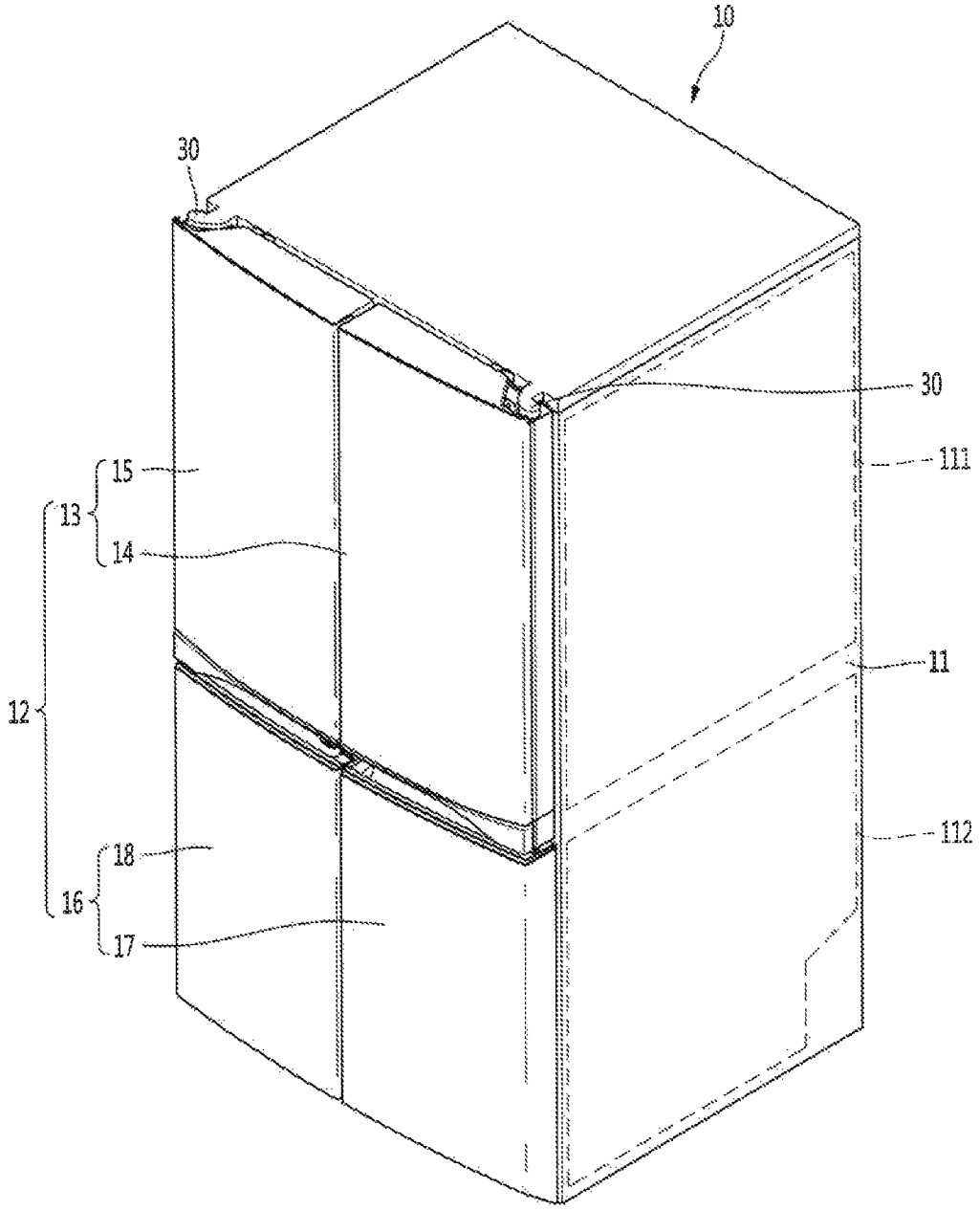
FIG. 1 is a perspective view illustrating a refrigerator according to a first embodiment of the present invention.

Hereinafter, exemplary embodiments of the present disclosure will be described in detail with reference to the exemplary drawings. Regarding the reference numerals assigned to the elements in the drawings, it should be noted that the same elements may be designated by the same reference numerals, wherever possible, even though they are shown in different drawings. Also, in the description of embodiments of the present invention, detailed description or well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 2:
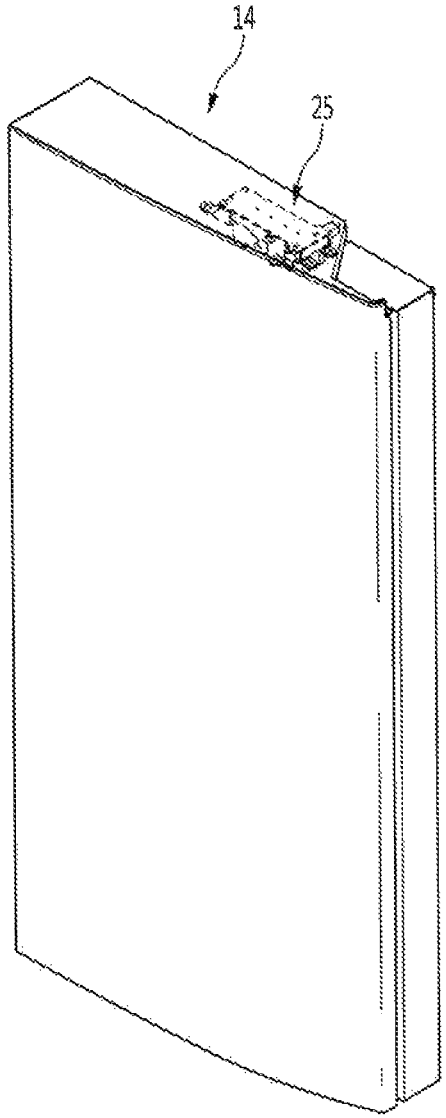
FIG. 2 is a perspective view illustrating a state where a door opening device is provided in first refrigerator door according to the second embodiment of the present invention.
Figure 3:
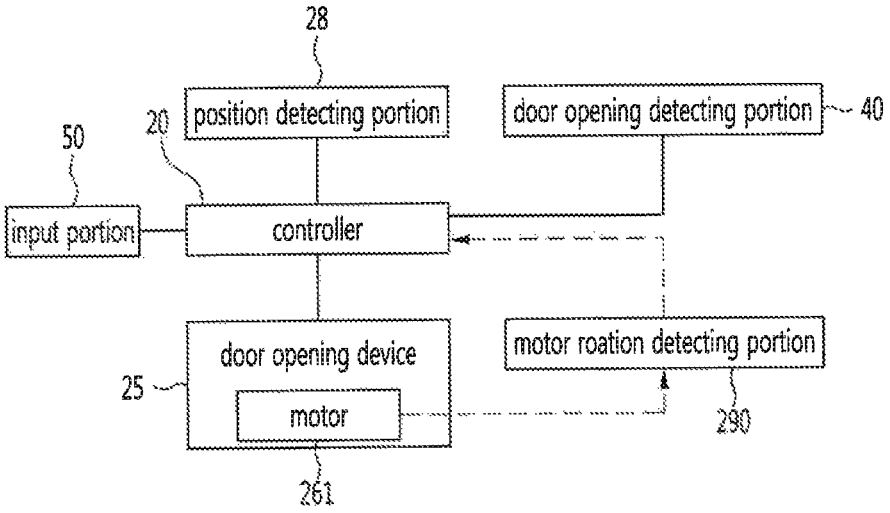
FIG. 3 is a block diagram according to the first embodiment of the present invention.

FIG. 1 is a perspective view illustrating a refrigerator according to a first embodiment of the present invention, FIG. 2 is a perspective view illustrating a state where a door opening device is provided in a first refrigerator door according to the second embodiment of the present invention, and FIG. 3 is a block diagram according to the first embodiment of the present invention.

With reference to FIG. 1 to FIG. 3, the refrigerator 10 according to a first embodiment of the present invention may include a cabinet 11 in which a storage compartment is provided, and refrigerator doors 12 which selectively open and close the storage compartment by being rotatably or slidably connected to the front surface of the cabinet 11.

Specifically, the storage compartment may include at least one of a refrigerating compartment 111 and a freezing compartment 112.

The refrigerating compartment 111 may be opened and closed by the refrigerating compartment door 13 and the freezing compartment 112 may be selectively opened and closed by the freezing compartment door 16.

In addition, in a case where the refrigerating compartment door 13 is a rotary door which opens and closes the refrigerating compartment 111, the refrigerating compartment door 13 may include a pair of doors 14 and 15 which is rotatably connected to a front left edge and a front right edge of the cabinet 11, respectively. In other words, the refrigerating compartment door 13 may include a first refrigerating compartment door 14 and a second refrigerating compartment door 15.

In a case where the freezing compartment door 16 which opens and closes the freezing compartment 112 is a rotary door, the freezing compartment door 16 may include a pair of doors 17 and 18 which are rotatably connected to a front left edge and a front right edge of the cabinet 11, respectively.

Alternatively, in a case where the freezing compartment door 16 is a drawer door which opens and closes the freezing compartment by sliding, a plurality of freezing compartment door may be arranged in the vertical direction or in the lateral direction.

The refrigerator 10 may further include a door opening device 25 which is operated in order to open the refrigerator door 12.

Hereinafter, automatic opening of the first refrigerating compartment door 14 of the refrigerator doors 12 by the door opening device 25 will be described as an example and other doors than the first refrigerating compartment door 14 can also be automatically opened by the structure and the method described below.

The door opening device 25 may be disposed on a door which requires opening. As an example, the door opening device 25 may be provided on each of a plurality of refrigerating compartment doors for opening each of the plurality of refrigerating compartment doors. In addition, in a case where one refrigerating compartment door includes a plurality of doors, the door opening device 25 may be provided to all or one of the plurality of doors.

Further, the door opening device 25 may be provided to the freezing compartment door 16 in order to open the freezing compartment door 16.

As another example, the door opening device 25 may be provided to the cabinet 11. At this time, the door opening device 25 may be provided in the same number as the number of the refrigerator doors.

In addition, in this embodiment, although a bottom freezer type refrigerator is disclosed, idea of opening the door may be applied to various types refrigerator such as a top-mount type refrigerator, a side-by-side type refrigerator, a refrigerator having only one storage compartment and only one door regardless of type thereof.

The first refrigerating compartment door 14 may be connected to the cabinet 11 by a hinge assembly 30. The first refrigerating compartment door 14 may be rotated by a hinge shaft (see 32 in FIG. 14) that provides a rotation center. The hinge shaft (see 32 in FIG. 14) may be provided to the first refrigerating compartment door 14 and/or the hinge assembly 30.

The refrigerator 10 further includes a position detecting portion 28 for detecting the position of a push rod (see 27 in FIG. 4) constituting the door opening device 25, a motor rotation detecting portion 290 for detecting the rotation of the motor 261 that generates power for operating push rod (see 27 in FIG. 4), and a controller 20 for controlling the door opening device 25 based on information detected at the position detecting portion 28 and the motor rotation detecting portion 290.

In addition, the refrigerator 10 may further include a door opening detecting portion 40 for detecting that the door has been opened to a reference angle or more and the controller 20 may control the door opening device 25, based on the information detected by the door opening detecting portion 40 so that the door opening device 25 can be controlled.

The control of the door opening device 25 by the controller 20 will be described later.

The refrigerator 10 may further include an input portion 50 for inputting a door open command. The input portion 50 may be a switch that is turned on by a user's touch, a touch screen that inputs a command of a user, a sensor for detecting a gesture of a user, or the like. The structure and method for inputting the door opening command in the present invention are not limited.

Hereinafter, the door opening device 25 will be described in detail.

Figure 4:
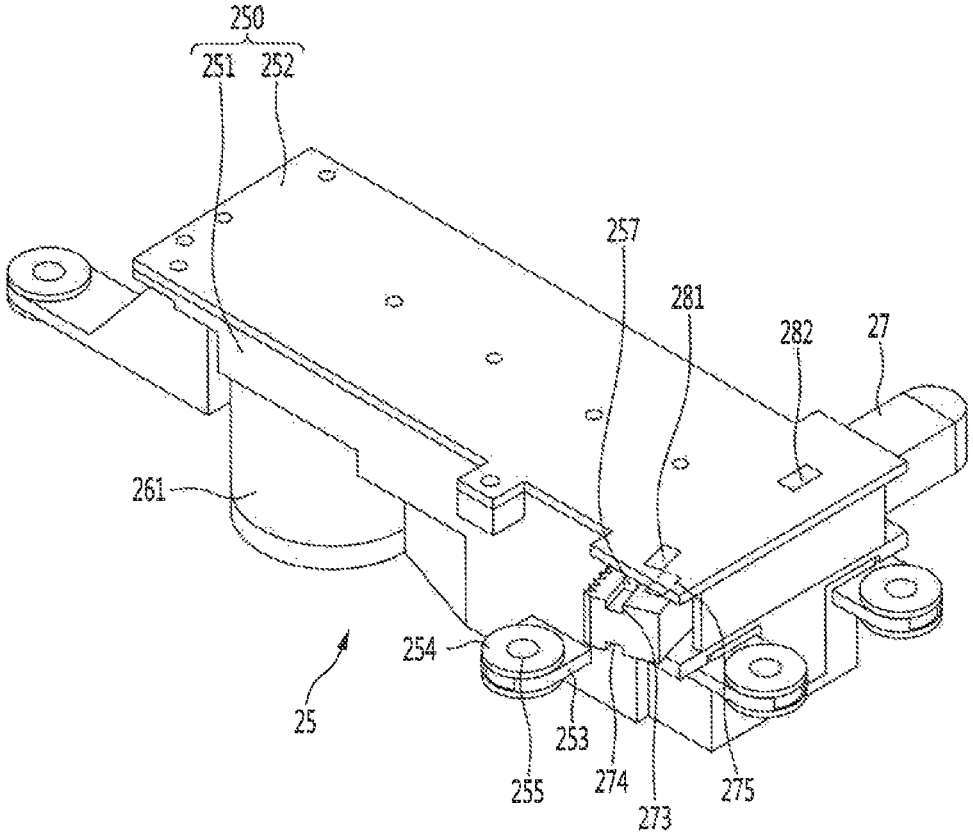
FIG. 4 is a view illustrating the door opening device according to the first embodiment of the present invention.
Figure 5:
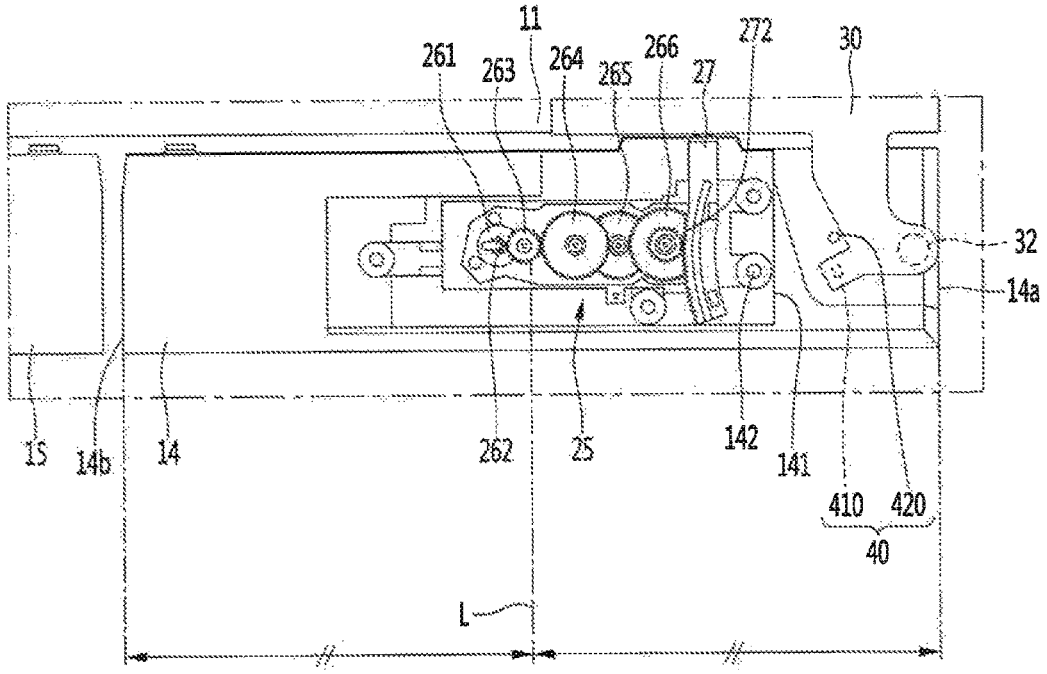
FIG. 5 is a plan view illustrating a state where the door opening door according to the first embodiment of the present invention is installed to the first refrigerator door.
Figure 6:
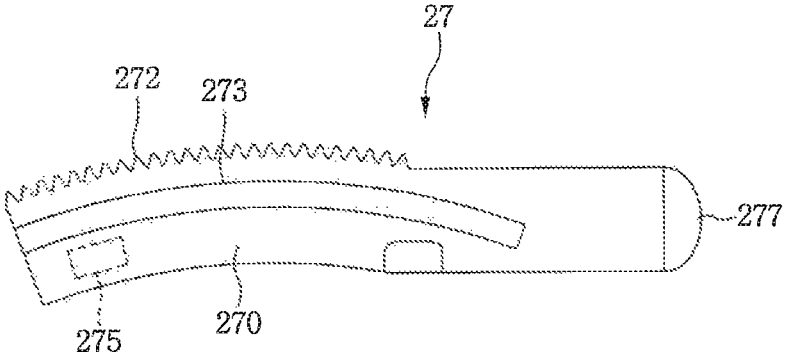
FIG. 6 is a view illustrating a push rod constituting the door opening device.
Figure 7:
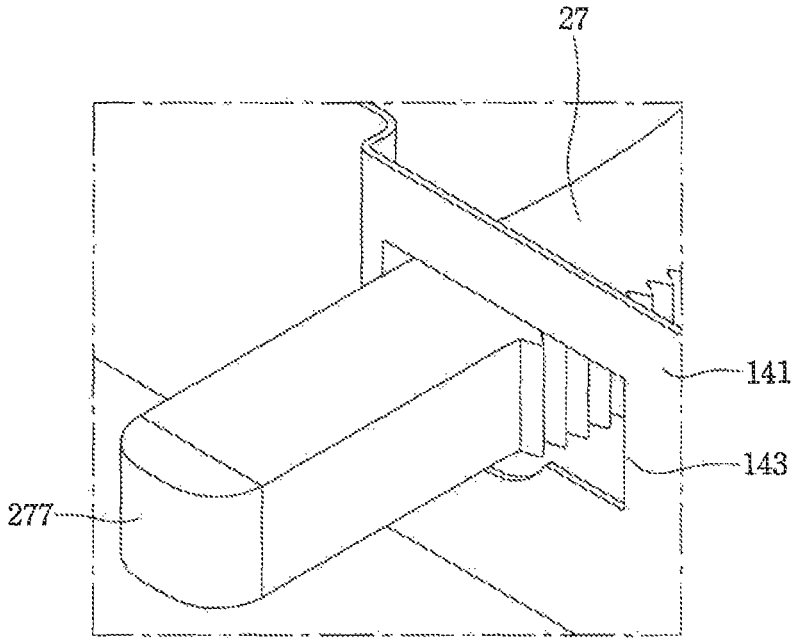
FIG. 7 is a view showing a state where the push rod of FIG. 6 projects from the frame of the first refrigerator door.

FIG. 4 is a view illustrating the door opening device according to the first embodiment of the present invention, FIG. 5 is a plan view illustrating a state where the door opening door according to the first embodiment of the present invention is installed to the first refrigerator door, FIG. 6 is a view illustrating a push rod constituting the door opening device, and FIG. 7 is a view showing a state where the push rod of FIG. 6 projects from the frame of the first refrigerator door.

With reference to FIG. 4 to FIG. 7, the door opening device 25 may be positioned on the upper side of the first refrigerating compartment door 14. A frame 141 may be provided on the upper side of the first refrigerating compartment door 14 to define a space for receiving the door opening device 25. The frame 141 can divide a space in which the heat insulating material (not shown) is accommodated and a space in which the door opening device 25 is accommodated in the refrigerating compartment door 14.

As another example, the door opening device 25 may be positioned at the lower side portion of the first refrigerating compartment door 14.

The door opening device 25 may include a housing 250 which is accommodated in the frame 141, a motor 261 which is installed on the housing 250 and which generates a driving force, a push rod 27 which is operated by receiving the driving force from the motor 261, and a power transmitting mechanism which transmits the driving force from the motor 261 to the push rod 27.

The housing 250 may include a first housing 251 and a second housing 252 coupled to the first housing 251, but it is not limited to this.

The first housing 251 may include a coupling portion 253 to which a shock absorbing portion 254 capable of absorbing impact or vibration is coupled. The shock absorbing portion 254 may include a hole 255 and the frame 141 may include a installing portion 142 which can be inserted into the hole 255 of the shock absorbing portion 254.

The vibrations generated during the operation of the motor 261 and the vibration generated during the operation of the power transmission mechanism are absorbed by the door opening device 25 being coupled to the frame 141 by the shock absorbing portion 254 and is capable of reducing noise. In addition, transfer of the vibrations from the motor 261 and the power transmission mechanism to the first refrigerating compartment door 14 can be prevented.

The power transmission mechanism may include at least one gear 262, 263, 264, 265, and 266.

In the present invention, the number of the gears is not limited as long as the power transmission mechanism can transmit the power of the motor 261 to the push rod 27. In FIG. 5, as an example, the power transmission mechanism includes a plurality of gears.

In a case where the push rod 27 is positioned in the first refrigerating compartment door 14, the push rod 27 is limited in its length, but the push rod 27 may include a rack gear 272 of a curved shape in order to secure the opening angle of the first refrigerating compartment door 14 by the push rod 27. At this time, the rack gear 272 can engage with the last one of the plurality of gears 262, 263, 264, 265, and 266.

As the rack gear 272 is formed in a curved shape, the length of the push rod 27 may be reduced when opening the first refrigerating compartment door 14 by a required angle.

Therefore, even if the push rod 27 is disposed on the first refrigerating compartment door 14, the first refrigerating compartment door 14 can be opened by the push rod 27 and then the opening angle may be increased compared to the linear rack gear.

As the rack gear 272 is formed in a curved shape, the push rod 27 is capable of relatively rotating with the last gear of the plurality of gears 262, 263, 264, 265, and 266 when the last gear is rotated.

In other words, the push rod 27 is capable of rotating with respect to the hinge shaft 32 together with the first refrigerating compartment door 14 during the operation of the motor 261 and rotating with respect to the plurality of gears 262, 263, 264, 265, and 266. As a result, the push rod is capable of performing a relative curve movement with respect to the first refrigerating compartment door 14.

The rack gear 272 may be formed in an arc shape. At this time, the rack gear 272 may be disposed so as to be convex in a direction away from the hinge shaft 32.

The center of the rack gear 272 having a curved shape can match the hinge shaft 32 in order to maintain a state where the push rod 27 is in contact with the front surface of the cabinet 11, when the push rod 27 moves relative to the freezer compartment door 14 by a relative curve movement.

At least one guide ribs 257 is provided to any one of the housing 250 and the push rod 27 and at least one guide grooves 273 and 274 in which at least one guide ribs 257 is accommodated may be provided to another one of the housing 250 and the push rod 27 so that the push rod 27 is stably moved.

At this time, at least one rib 257 and at least one guide grooves 273 and 274 may be formed in a curved shape.

Alternatively, at least one rib 257 may be formed in a circular or rectangular shape, and at least one guide grooves 273 and 274 may be formed in a curved shape.

In FIG. 4, as an example, at least one guide rib 257 is provided in the housing 250 and at least one guide groove 273 and 274 is provided in the push rod 27.

The guide grooves 273 and 274 may be provided on the first surface (the upper surface with reference to the drawing) and the second surface (the lower surface with reference to the drawing) facing the first surface of the push rod 27, respectively. The guide ribs 257 may be provided in the first housing 251 and the second housing 252, respectively. However, they are not limited to these.

The guide grooves 273 and 274 may be formed in an arc shape. At this time, the guide grooves 273 and 274 may be arranged to be convex in a direction away from the hinge shaft 32. The center of the arc of the guide grooves 273 and 274 may be the hinge shaft 32.

On the other hand, the push rod 27 may be positioned to be adjacent to the hinge shaft 32. As the push rod 27 is positioned to be adjacent to the hinge shaft 32, the door opening device 25 is further simple and is compacted and the length of the push rod 27 can be further reduced.

The hinge shaft 32 can be positioned on the upper surface of the first refrigerating compartment door 14. The first refrigerating compartment door 14 may include a first side surface 14*a* and a second side surface 14*b* facing the first side surface 14*a* and the hinge shaft 32 may be positioned to be adjacent to the first side surface 14*a*.

In other words, the hinge shaft 32 may be positioned in an area which corresponds to an area between a virtual line L which bisects an interval between the first side surface 14*a* and the second side surface 14*b* and the first side surface 14*a*, based on the virtual line L.

The push rod 27 may be positioned between the motor 261 and the hinge shaft 32. Further, the push rod 27 may be positioned in an area corresponding to the area between the virtual line L and the first side surface 14*a*. At this time, the push rod 27 may be positioned between the virtual line L and the hinge shaft 32.

Accordingly, according to the present invention, as the push rod 27 is positioned to be adjacent to the hinge shaft 32, the opening angle of the first refrigerating compartment door 14 may be increased by using the push rod 27 having a short length.

The plurality of gears 262, 263, 262, 265 and 266 are rotated in the forward direction by the rotation of the motor 261 in one direction and thus the push rod 27 may move in the the direction in which the push rod 27 is drawn out from the first refrigerating compartment door 14 for opening the door.

On the other hand, the plurality of gears 262, 263, 264, 265, and 266 are rotated in the reverse direction by the rotation of the motor 261 in the other direction, and the push rod 27 can be inserted into the first refrigerating compartment door 14.

At this time, each of the plurality of gears 262, 263, 264, 265, and 266 may be a planar gear so that each of the plurality of gears 262, 263, 264, 265, and 266 is capable of being rotated in the reverse direction by an outside force applied to the push rod 27, during opening process of the door or after opening completion of the door before return of the push rod 27 to the initial position.

Therefore, even if an external force is applied to the push rod 27, the plurality of gears 262, 263, 264, 265, and 266 can be rotated in the reverse direction and thus the plurality of gears 262, 263, 264, 265, and 266 and the push rod 27 are prevented from being damaged.

Alternatively, some or all of the plurality of gears may be multi-stage gears having two gear bodies of different diameters.

Meanwhile, the position detecting portion 28 may include a first position sensor 281 and a second position sensor 282. The first position sensor 281 and the second position sensor 282 may be disposed in the housing 250, as an example.

The push rod 27 may include a magnet 275. The first position sensor 281 and the second position sensor 282 may be a magnetic sensor for detecting the magnetic field of the magnet 275.

The position of the push rod 27 when the first position sensor 281 detects the magnet 275 or the position of the push rod 27 when the first position sensor 281 faces the magnet 275 can be referred to as an initial position, in the present specification.

The position of the push rod 27 when the second position sensor 282 detects the magnet 275 or the position of the push rod 27 when the second position sensor 281 faces the magnet 275 can be referred to as a door opening position (or a final position).

In the present embodiment, the first refrigerating compartment door 14 may be opened during the movement from the initial position to the door opening position of the push rod 27.

In this specification, "opening of door" means that the storage room which is opened and closed by the door communicates with the outside of the refrigerator.

The controller 20 may control the motor 261 based on information detected by the position sensors 281 and 282. For example, the controller 20 may rotate the motor 261 in one direction and may stop the motor 261 when it is detected that the push rod 27 has moved to the door opening position.

The controller 20 rotates the motor 261 in the other direction so that the push rod 27 returns to the initial position when the push rod 27 is moved to the door opening position and then a predetermined time has lapsed in a state where the motor is stopped.

According to the present embodiment, the reason why the motor 261 is rotated in the other direction after a predetermined time elapses after the motor 261 is stopped is to keep the first refrigerating compartment door 14 in an open state.

In other words, in a case where the push rod 27 moves to the door opening position and returns to the initial position without maintaining the stopped state, there is a problem that the first refrigerating compartment door 14 is immediately closed due to a load of the first refrigerating compartment door 14 itself (including the load of the food stored in the first refrigerating compartment door 14), a magnetic force of magnet which is provided to a gasket (not illustrated) for closely contacting the first refrigerating compartment door 14 with the cabinet 11, and closing force by an automatic closing mechanism (not shown) which is provided in the hinge assembly 30 for automatically closing the door.

However, as in the present invention, when the motor 261 is rotated in the forward direction after predetermined time has elapsed after the motor 261 is asserted, Since the first refrigerating compartment door 14 can be kept open for a predetermined time, the user can manually increase the opening angle of the first refrigerating compartment door 14 manually.

As another example, the first position sensor 281 and the second position sensor 282 may be light sensors. The push rod 27 may include grooves or projection portions, and the position sensors 281 and 282 may detect grooves or projection portions. It is noted that there is no limitation in the configuration for detecting the position of the push rod 27 in this embodiment.

The push rod 27 may further include a contact end portion 277 capable of contacting the front surface of the cabinet 11 (the front end of the hinge assembly). The contact end 277 may be made of a rubber material to prevent the front surface of the cabinet 11 from being damaged by the contact with the push rod 27.

Meanwhile, the frame 141 installed in the first refrigerating compartment door 14 may be provided with an opening 143 through which the push rod 27 passes.

In a present embodiment, since the push rod 27 moves relative to the refrigerating compartment door 14 by a relative curve movement, sectional area of the push rod 27 may be larger than the vertical cross-sectional area of the push rod 27, in order to prevent the push rod 27 from interfering with the frame 14.

Meanwhile, the door opening detecting portion 40 includes a magnet 420 which is provided to any one of the first refrigerating compartment door 14 and the hinge assembly 30 and a detecting sensor 410 which is provided to the other one of the first refrigerating compartment door 14 and the hinge assembly 30 and which detects the magnetic field of the magnet 420.

In FIG. 5, as an example, the detecting sensor 410 is disposed on the hinge assembly 30.

The detecting sensor 410 may be easily assembled and serviced in a case where the detecting sensor 410 is provided to the hinge assembly 30. In other words, without separating the first refrigerating compartment door 14, the hinge assembly 30 can be separated and the detecting sensor 410 can be accessed.

The detecting sensor 410 and the magnet 420 may be disposed to be adjacent to the hinge shaft 32. Therefore, the detecting sensor 410 can directly detect the position of the magnet 420 of the first refrigerating compartment door 14 in the rotating process of the refrigerating compartment door 14 and thus rotation of the first refrigerating compartment door 14 by a reference angle can be accurately detected.

In addition, since the detecting sensor 410 and the magnet 420 are positioned in contact with the hinge shaft 32, it is possible to detect the door opening without interfering with other peripheral structures.

When the magnet 420 is positioned below the detecting detector 410 in the process of opening the first refrigerating compartment door 14, the detecting sensor 410 detects the magnetic field of the magnet 420, and the controller 20 is capable of controlling the motor 261 in order to return the push rod 27 to its initial position.

Meanwhile, the motor rotation detecting portion 290 may detect the rotation of the shaft of the motor 261. As an example, a rotary plate may be connected to the shaft of the motor 261. The plurality of slits may be spaced apart from each other in the circumferential direction and be arranged.

The motor rotation detecting portion 290 may include a light emitting portion positioned on one side of the rotary plate and a light receiving portion positioned on the other side of the rotary plate, as an example.

Accordingly, when the rotary plate is rotated at the time of rotation of the motor, the motor rotation detecting portion 290 can detect the number of slits when the rotating plate is rotated. In other words, the motor rotation detecting portion 290 outputs a pulse when detecting the slit, and the controller 20 can grasp the rotation speed (rpm) of the motor 261 based on the pulse output from the motor rotation detecting portion 290 and the moving distance of the push rod 27 can be determined.

Hereinafter, the operation of the door opening device will be described.

Figure 8:
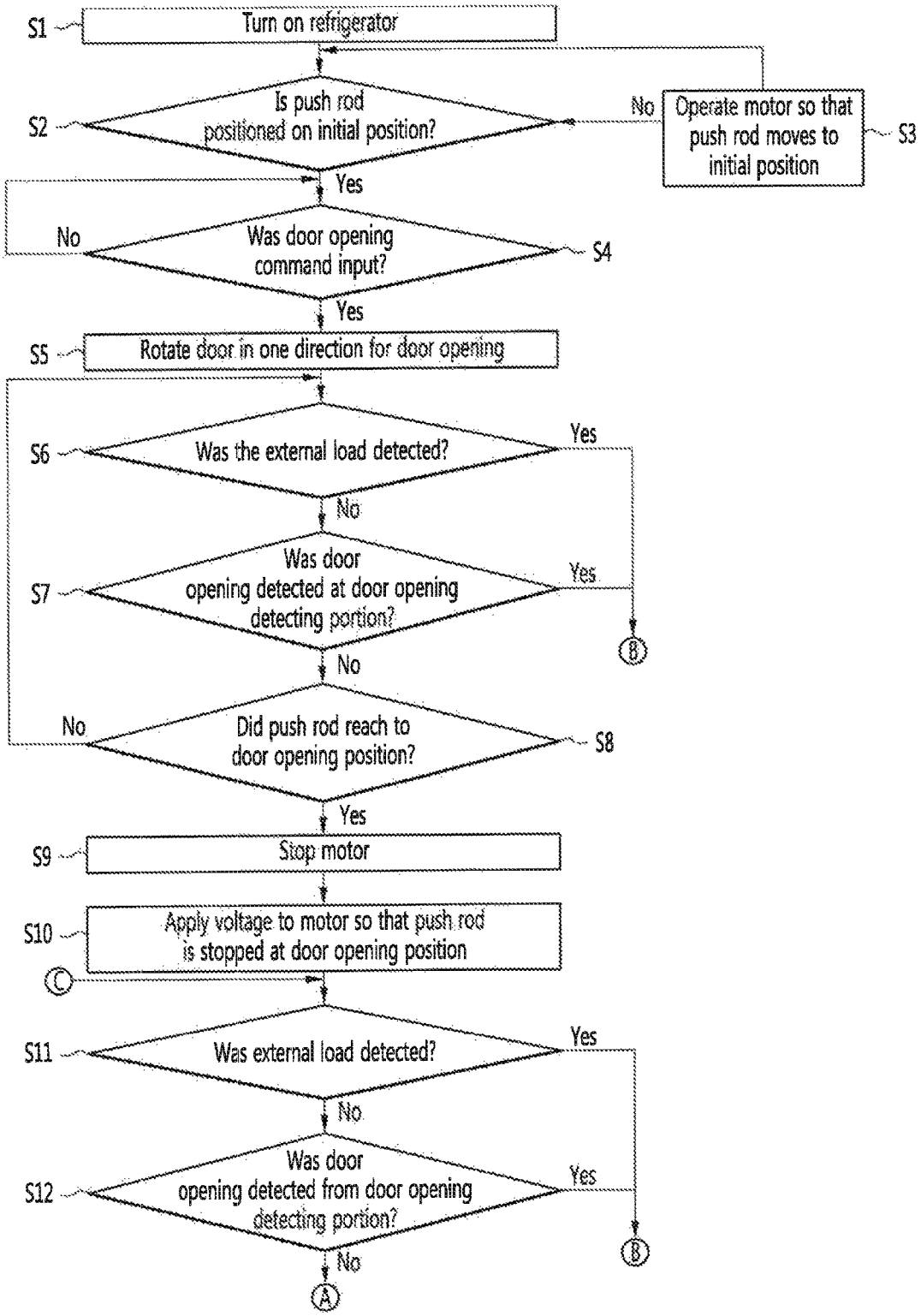
FIG. 8 and FIG. 9 are a flow chart for explaining an operation of the door opening device according to the first embodiment of the present invention.
Figure 9:
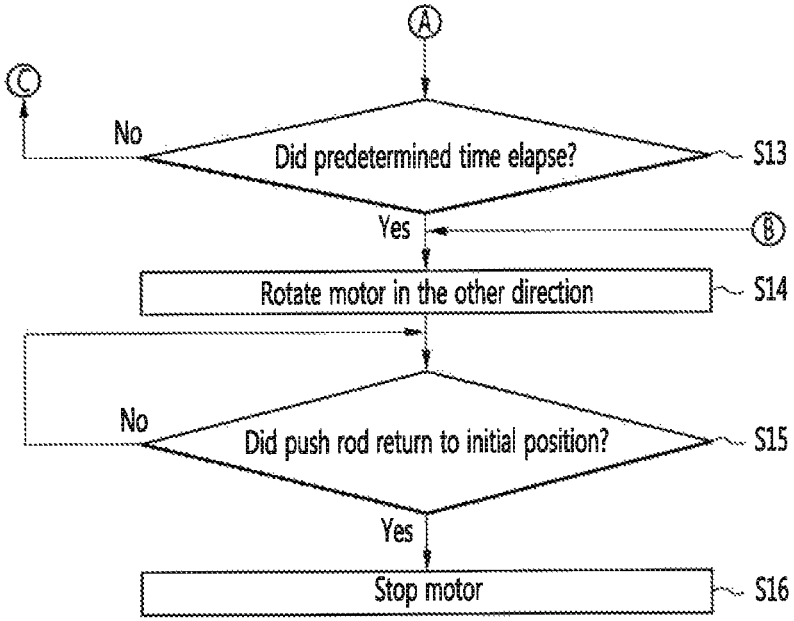
Figure 10:
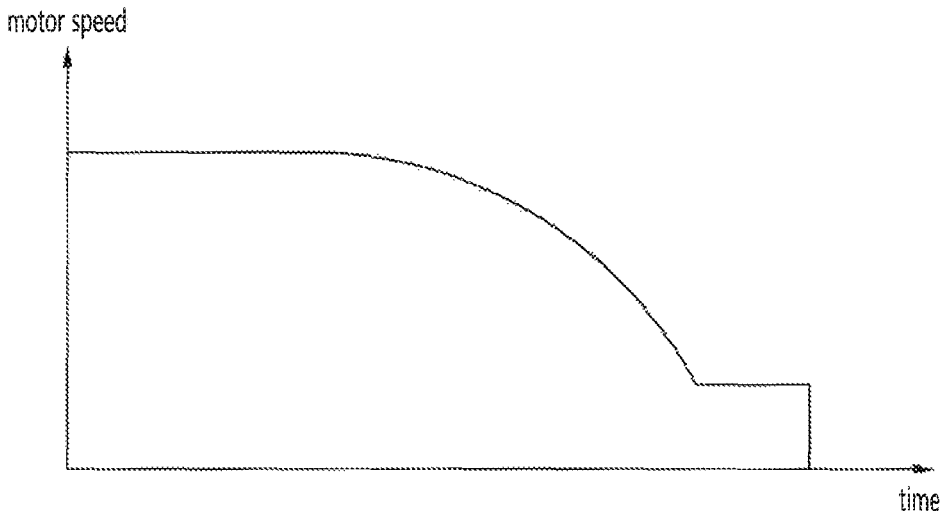
FIG. 10 is a graph showing a rotating speed of a motor in a process of door opening.
Figure 11:
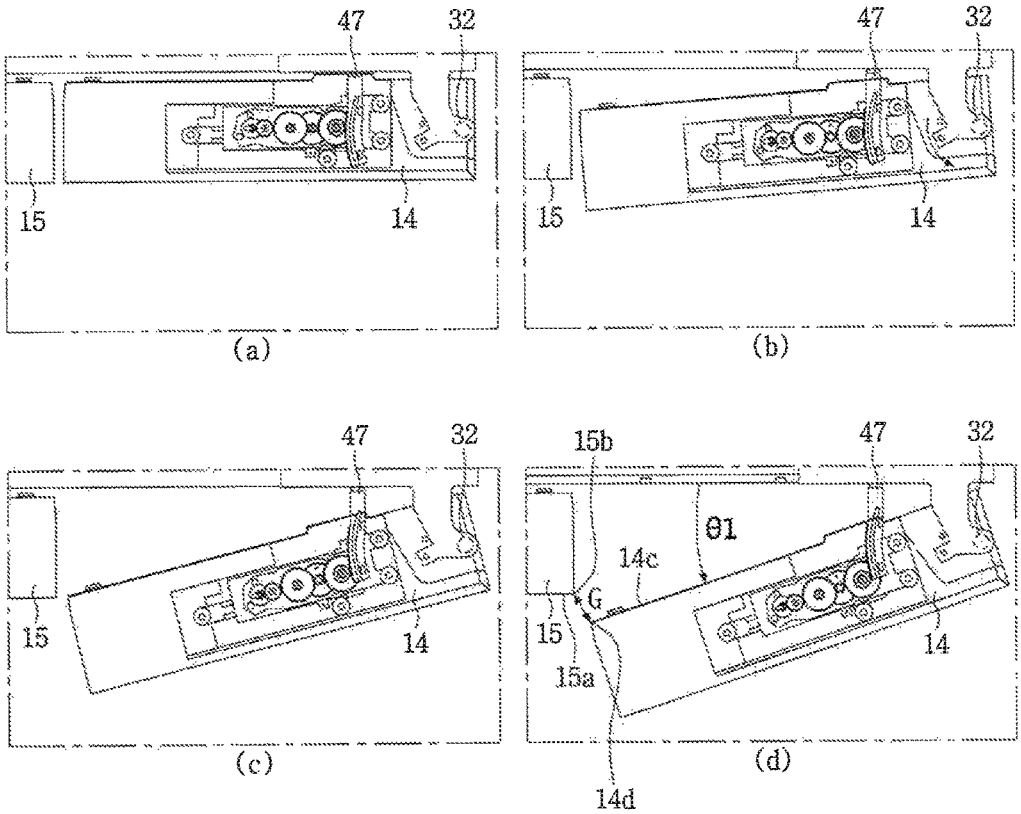
FIG. 11 is a view showing a state where the push rod according to the first embodiment of the present invention moves to the door opening position and thus the door is opened.
Figure 12:
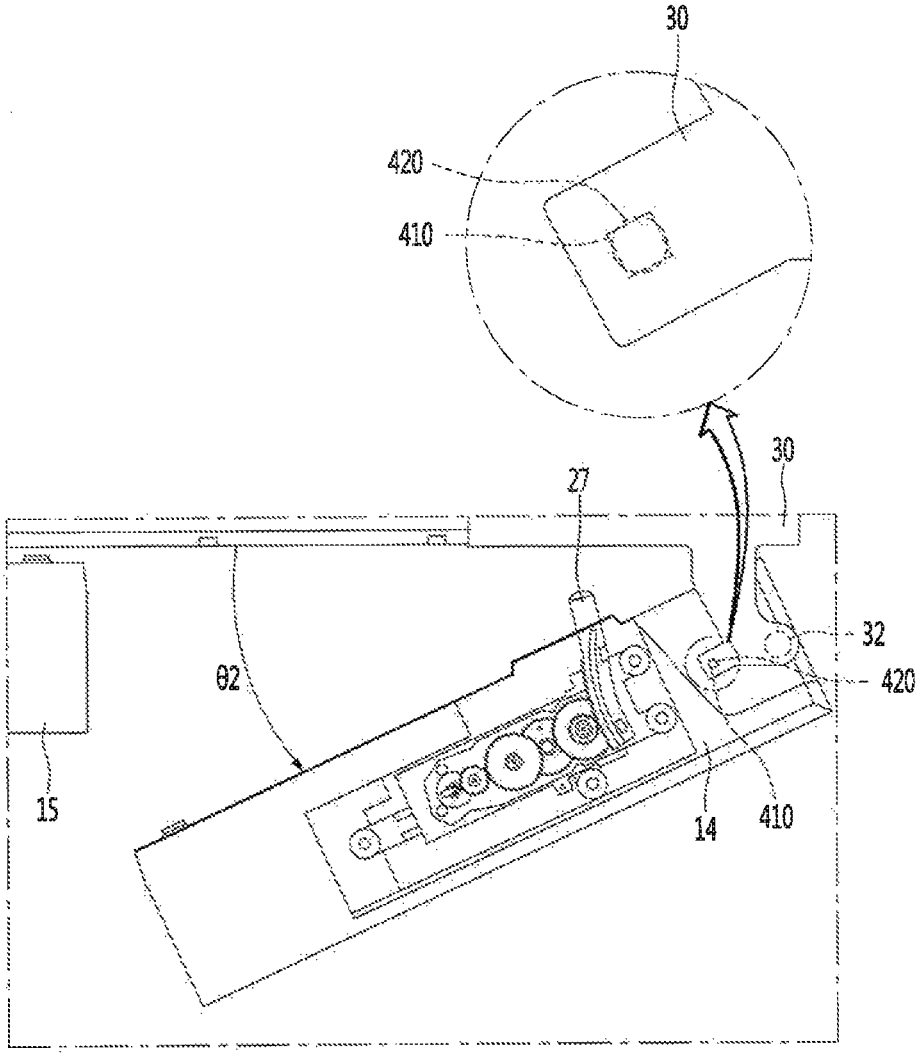
FIG. 12 is a view showing a state where the first refrigerator door according to the first embodiment of the present invention is opened by a reference angle.

FIG. 8 and FIG. 9 are a flow chart for explaining an operation of the door opening device according to the first embodiment of the present invention, FIG. 10 is a graph showing a rotating speed of a motor in a process of door opening, FIG. 11 is a view showing a state where the push rod according to the first embodiment of the present invention moves to the door opening position and thus the door is opened, and FIG. 12 is a view showing a state where the first refrigerator door according to the first embodiment of the present invention is opened by a reference angle.

Referring to FIG. 1 to FIG. 12, the refrigerator 10 is turned on (S1).

When the refrigerator 10 is turned on, the controller 20 determines whether the push rod 27 is in the initial position (S2).

If it is determined in step S2 that the push rod 27 is not positioned at the initial position, the controller 20 operates the motor 261 to move the push rod 27 to the initial position (S3).

The first position sensor 281 is in a state of detecting the magnet 275 of the push rod 27 in a state where the push rod 27 is in the initial position.

In a state where the push rod 27 is positioned at the initial position, the controller 20 determines whether a door open signal is inputted through the input portion 50 (S4).

If it is determined in step S4 that the door open signal has been input, the controller 20 controls the motor 261 so that the motor 261 rotates in one direction (S5).

In other words, the controller 20 may supply voltage to the motor 261 to move the push rod 27 from the initial position to the door open position so that the motor 261 is rotated in the first direction have.

When the motor 261 rotates in one direction of the arrow 262, the plurality of gears 262, 263, 262, 265, and 266 are rotated in the forward direction and the push rod 27 pushes the cabinet 11 and thus, as a reaction to this, the first refrigerating compartment door 14 is rotated.

While the motor 261 rotates in one direction of the arrow 261, the controller 20 determines whether an external load acts on the first refrigerating compartment door 14 in the direction in which the first refrigerating compartment door 14 is closed (S6).

Specifically, when the motor 261 is rotated, a pulse is output from the motor rotation detecting portion 290. At this time, when the external load operates on the first refrigerating compartment door 14, the rotating speed of the motor is reduced. According to this, the number of pulses per unit time output from the motor rotation detecting portion 290 is reduced.

Accordingly, the controller 20 can judge that the external load virtual device 1 operates on the first refrigerating compartment door 14, when the number of pulses output for a unit time is equal to or less than the first load detecting number.

However, since the number of pulses per unit time output from the motor rotation detecting portion 290 may be equal to or less than the first load detecting number at the beginning of operation of the motor 261, the determination whether or not the external load is detected may be performed after the motor 261 operates in one direction and then the reference time has lapsed.

If the motor 261 is continuously operated in a state where the number of pulses output for the unit time is equal to or less than the first load detecting number in the motor rotation detecting portion 290, the push rod 27 and/or gear are (is) or the motor 261 may be damaged due to overload of the motor 261.

Accordingly, in the present embodiment, when it is determined that an external load is applied to the first refrigerating compartment door 14, the controller 20 controls the motor 261 to rotate in the other direction of the motor 261 so that the push rod 27 returns to the initial position.

On the other hand, if it is determined in step S6 that no external load is detected, the controller 20 determines whether the door opening detecting portion 40 detects the door opening (S7).

In this specification, a case where the door opening detection unit 40 detects the door opening while the motor 261 is being rotated in one direction is a case the first refrigerating compartment door 14 is rotated in the direction in which first refrigerating compartment door 14 is opened by user.

The opening angle (θ2) of the first refrigerating compartment door 14 when the door opening detecting portion 40 detects the opening of the door is larger than the opening angle (θ1) of the first refrigerating compartment door 14 when the push rod 27 is moved to the opening position.

When the refrigerating compartment door 14 is rotated over the reference angle in the process of the first refrigerating compartment door 14 being rotated to be opened the door opening sensor 40 detects the opening of the door.

The projecting length of the push rod 27 from the first refrigerating compartment door 14 is increased while the motor 261 is rotated in one direction. If the first refrigerating compartment door 14 is closed after the opening angle of the first refrigerating compartment door 14 is increased in a state where the push rod 27 protrudes from the first refrigerating compartment door 14, the push rod (27) collides with the cabinet 11, and thus there is a problem that the push rod 27 is damaged or the gears constituting the power transmission mechanism are damaged.

At this time, the greater the opening angle of the first refrigerating compartment door 14, the greater the impact force applied to the push rod 27 when the first refrigerating compartment door 14 is closed. Further, the longer the protruding length of the push rod 27 from the first refrigerating compartment door 14 is, the greater the possibility of breakage of the push rod 27 is.

In this embodiment, in order to prevent the push rod 27 and/or the gears which constitutes the power transmission mechanism from being damaged by the first refrigerating compartment door 14 being opened and then closed by a user while the motor 261 is being rotated in one direction, in a case where the door opening is detected at the door opening detecting portion 40, the controller 20 causes the motor 261 to rotate in the other direction so that the push rod 27 returns to the initial position (S14).

According to the present embodiment, in a case where the door opening detecting portion 40 detects the door opening in a process of the push rod 27 moving from the initial position to the door opening position by the motor 261 operating in one direction, the push rod 27 is capable of being returned to the initial direction by the motor 261 being rotated in the other direction before the push rod 27 is moved to the door opening position.

Therefore, since the push rod 27 is moved to the initial position in the process of rotating in the closed direction after the rotation of the first refrigerating compartment door 14 by the reference angle or more. The push rod 27 and the cabinet 11 can be prevented from being damaged by the impact of the push rod and the gears.

Meanwhile, in a case where it is determined in step S7 that door opening is not detected in the door opening detecting portion 40 while the motor 261 is rotating in one direction, the controller 20 is capable of determining whether or not the push rod 27 reaches the door opening position. (S8).

In other words, when the motor 261 is rotated in the direction in which the push rod 27 is positioned at the initial position, the push rod 27 is moved in a curved line. In this process, the first position sensor 281 The push rod 27 is detected by the second position sensor 282 in the course of the curved movement of the push rod 27. In this case, The controller 20 can determine that the push rod 27 reaches the door opening position.

If it is determined in step S8 that the push rod 27 reaches the door opening position, the controller 20 stops the motor 261 (S9).

Specifically, FIG. 11 (*a*), when the motor 261 rotates in one direction in a state where the push rod 27 is positioned at the initial position, the push rod 27 moves along the curve, and moves toward the front surface of the cabinet 11.

The push rod 27 pushes the front surface of the cabinet 11 when the push rod 27 comes into contact with the front surface of the cabinet 11 and the rotating force is applied to the first refrigerating compartment door 14 by reaction due to force of the push rod 27 pushing the front surface of the cabinet and thus the first refrigerating compartment door 14 can be rotated about the hinge shaft 32 in the counterclockwise direction by the rotation force acting on the first refrigerating compartment door 14. In this manner, the refrigerating compartment door 14 is capable of opening automatically.

At this time, as the moving distance of the push rod 27 increases, the opening angle of the first freezing compartment door 14 is increased as shown in (b) and (c) of FIG. 11.

The moving distance of the push rod 27 in this embodiment actually means the protruding length of the push rod 27 when the push rod 27 projects from the first freezing compartment door 14.

As in FIG. 11 (*d*), when the push rod 27 reaches the door opening position, the motor 261 can stop.

At this time, in the present embodiment, in a state where a contact end portion 277 of the push rod 27 maintains a state of contacting with a portion of front surface of the cabinet 11 by the rack gear 272 of the push rod 27 being formed in a curved shape and the center of the curve becoming the hinge shaft, the projecting length of the push rod 27 is increased by the rotation of the first refrigerating compartment door 14 and the opening angle of the first refrigerating compartment door 14 is increased.

The damage and noise of the cabinet 11 by the slip of push rod 27 can be prevented by the first refrigerating compartment door 14 is opened while maintaining a state where the push rod 27 is in contact with a portion of the front surface of the cabinet 11.

In a case where the push rod 27 includes a linear rack gear, it can easily be guessed that a slip phenomenon in which the contacting end portion of the push rod 27 moves to the left side of the drawing will be generated at one point on the front face of the cabinet 11 when the first refrigerating compartment door 14 is opened.

The virtual line which connects engagement point with the last gear of the plurality of gears 262, 263, 262, 265, and 266 in the gear 272 in the rack gear 272 and the contact end portion 277 of the push rod 27 can be perpendicular to the front surface in a state where the push rod 27 reaches the door opening position by the rack gear 272 of the push rod 27 being formed in a curved shape.

Further, as the rack gear 272 of the push rod 27 is formed in a curved shape, the opening angle of the door can be increased as compared with the case where the rack gear 272 of the push rod 27 is formed in a linear shape.

Further, when the door is to be opened by a certain angle, the length of the push rod in a case where the push rod is provided with a curved rack gear is shorter than the length of the push rod when the push rod is provided with a linear rack gear, have. Accordingly, the door opening device can be made compact, and when the door opening device is made compact, there is an advantage that the door opening device can be installed for automatic opening of the door even when the thickness of the door is reduced.

Meanwhile, as in FIG. 11 (*d*), in a state where the push rod 27 reaches the door opening device, at least a part of the rear surface 14*c* of the first refrigerating compartment door 14 may be positioned in the front side of the front surface 15*a* of the second refrigerating compartment door 15.

Therefore, there is a gap G between an edge 14*d* of side which is adjacent to the second refrigerating compartment door 15 in the rear surface 14*c* of the first refrigerating compartment door 14 and an edge 15*b* of side which is adjacent to the first refrigerating compartment door 14 in the front surface 15*a* of the second refrigerating compartment door 15.

The gap G may be set to a degree to which the user's elbow or foot can be inserted in the case where both hands of the user are not free. The gap G may be equal to or greater than 40 mm. However, it is not limited to this. In other words, the minimum horizontal distance between the rear surface of the opened first refrigerating compartment door and the front surface of the closed second refrigerating compartment door may be 40 mm.

The opening angle (θ1) of the first refrigerating compartment door 14 at the position where the push rod 27 reaches the door opening position may be 19 degrees to 30 degrees so that the gap C becomes 40 mm or more.

According to the present embodiment, since the push rod 27 includes the rack gear 272 in the form of a curved line and is positioned adjacent to the hinge shaft 32, the opening angle (θ1) of the first refrigerating compartment door 14 can be secured at the position where the rod 27 reaches the door opening position while the projecting length of the push rod 27 is reduced.

Therefore, in a case where the first refrigerating compartment door 14 is rotated by the opening angle (θ1), the user inserts the elbow or the foot into the gap C to manually increase the opening angle of the first refrigerating compartment door 14.

Meanwhile, when the motor 261 is rotated in one direction and thus the push rod 27 moves from the initial position to the door opening position, in a case where the rotating speed of the motor 261 is constant, the first refrigerating compartment door 14 cannot smoothly stop and rattles in the process of the push rod 27 reaching the door opening position and stopping the motor 261. In this case, the user's emotional complaint can be generated.

Accordingly, in this embodiment, the rotation speed of the motor 261 is varied in the process of the push rod 27 moving from the initial position to the door opening position by the motor 261 being rotated in one direction.

Specifically, with reference to FIG. 10, the controller 20 controls the motor 261 so that the motor 261 is rotated at a first reference speed until the number of pulses detected by the motor rotation detecting portion 290 reaches a first reference number, The motor 261 can be controlled.

When the number of pulses detected by the motor rotation detecting portion 290 reaches a first reference number, the controller 20 may control the motor 261 so that the rotating speed of the motor 261 is decreased until the number of pulses detected by the motor rotation detecting portion 290 reaches a second reference number which is larger than the first reference number.

At this time, the controller 20 can control the rotation speed of the motor 261 so that the rotation speed of the motor 261 linearly or nonlinearly decreases.

When the rotation speed of the motor 261 reaches the second reference speed, the controller 20 can control the motor 261 so that the rotation speed of the motor 261 is maintained at the second reference speed. In a case where the second position sensor 182 detects the magnet 275 of the push rod 27 while the rotating speed of the motor 261 is maintained in the second reference speed, the controller 20 is capable of stopping the motor 261.

Therefore, according to the present embodiment, since the moving speed of the push rod 20 is reduced in the process of moving the push rod 20 from the initial position to the door open position and stopped at the door open position in the reduced speed state, a rattling phenomenon is prevented in the opening process of the first refrigerating compartment door 14 and the first refrigerating compartment door 14 can be smoothly stopped.

At this time, the point at which the number of pulses output from the motor rotation detecting portion 290 reaches the first reference number may be a point between the point bisecting the distance between the initial position of the push rod 27 and the door opening position and the door opening position.

The faster the rotation speed of the motor 261 is, the smaller the door opening time can be.

In a case where the point at which the number of pulses output from the motor rotation detecting portion 290 reaches the first reference number is a point between the point bisecting the distance between the initial position of the push rod 27 and the door opening position and the door opening position, the high-speed rotation time of the motor 261 can be sufficiently secured, the door opening time can be reduced, and the rattling of the door when the door is opened can be prevented.

Meanwhile, when the push rod 27 reaches the door opening position, at least a part of the rear surface 14*c* of the first refrigerating compartment door 14 may be positioned in front of the front surface 15*a* of the second refrigerating compartment door 15. According to this, a gap may be formed between one side end portion of the rear surface 14*c* of the first refrigerating compartment door 14 and the one side end portion of the front surface 15*a* of the second refrigerating compartment door 15.

The gap can be set to such an extent that the user's elbow or foot can be inserted in a case where the user's hands are not free.

Therefore, the opening angle of the first refrigerating compartment door 14 can be manually increased by inserting the elbow or the foot into the gap in a state where the first refrigerating compartment door 14 is rotated at the angle (θ1).

Meanwhile, in a state where the push rod 27 reaches the door opening position and the motor 261 is stopped, the controller 20 supplies voltage to the motor 261 so that the push rod 27 maintains a state of stopping at the door opening position in a state where the motor 261 is stopped. (Step S10).

In other words, the controller 20 stops the motor 261 when the push rod 27 is moved to the virtual pier opening position, and in a state where the motor is stopped, voltage is supplied to the motor 261 so that the push rod 27 maintains a stopped state at the door opening position.

As described above, the push rod 27 is pushed toward the initial position by at least one of a load of the first refrigerating compartment door 14 itself, a magnetic force of magnet which is provided to a gasket (not illustrated) for closely contacting the first refrigerating compartment door 14 with the cabinet 11, and a closing force by an automatic closing mechanism (not shown) which is provided in the hinge assembly 30 for automatically closing the door. In this case, the phenomenon of the motor 261 being rotated in the other direction may generate.

However, according to the present embodiment, since the push rod 27 is supplied with the voltage to the motor 261 so as to be kept stationary at the door opening position, the push rod 27 is not moved and maintains the stopped state. Accordingly, the rotation of the motor 261 in the other direction is prevented.

However, the supply period of the voltage supplied to the motor 261 may be set based on the magnitude of the external force acting on the push rod 27.

In other words, even if a voltage is supplied to the motor 261, the shaft of the motor 261 is not rotated by the external force acting on the push rod 27, and the push rod 27 can be kept stationary. Therefore, even if a voltage is supplied to the motor 261, the rotation detecting unit 290 does not output a pulse.

In this embodiment, the speed of rotation of the motor 261 may be varied depending on the duty of the voltage supplied to the motor 261. A voltage of a predetermined magnitude may be periodically supplied to the motor 261. The shorter the supply period of the voltage supplied to the motor 261 (or the larger the duty), the faster the rotation speed of the motor 261 can be.

In the present embodiment, the supply period of the voltage which is supplied to the motor 261 when the push rod 27 reach on the door opening position is longer than the supply period of the voltage which is supplied to the motor 261 when the motor 261 maintains the second reference speed.

In a state where the motor 261 is stopped, the controller 20 determines whether an external load acting on the first refrigerating compartment door 14 is detected in a direction in which the first refrigerating compartment door 14 is closed (S11).

Specifically, pulse does not output at the motor rotation detecting portion 290 in a state where the motor 261 is stopped. However, in a case where external load is applied to the first refrigerating compartment door 14, since the motor 261 rotates in the other direction, pulse is output from the motor rotation detecting portion 290.

Therefore, if the number of pulses outputted for a unit time is equal to or greater than the second load detecting number, the controller 20 determines that an external load is operated to the first refrigerating compartment door 14. There is a possibility that the push rod 27 and/or the gear may be damaged if the user forcibly closes the first refrigerating compartment door 14 in the stopped state of the motor 261.

Accordingly, in the present embodiment, when it is determined that the external load operates to the first refrigerating compartment door 14 in a state where the push rod 27 is stopped at the door opening position, the controller 20 rotates the motor 261 in the other direction 261 (S14).

On the other hand, if it is determined in step S11 that no external load is applied, the controller 20 determines whether the door opening detecting portion 40 detects the door opening (S12).

In a case where the door opening detection unit 40 detects the door opening in a state where the push rod 27 reaches the door opening position is a case where the opening angle of the first refrigerating compartment door 14 is increased by a user.

As described above, the opening angle (θ1) of the first refrigerating compartment door 14 in the state in which the push rod 27 reaches the door opening position is smaller than the opening angle (θ2) of the first refrigerating compartment door 14 when the door opening detecting portion 40 detects the opening of the first refrigerating compartment door 14.

Accordingly, when the opening angle of the first refrigerating compartment door 14 is increased in a state where the push rod 27 reaches the door opening position, the door opening detecting portion 40 detects the door opening.

If it is determined in step S12 that the door opening detecting portion 40 detects the opening of the door, the controller 20 can rotate the motor 261 in the other direction so that the push rod 27 returns to the initial position (S12).

The push rod 27 and/or the gear can be damaged even if the first refrigerating compartment door 14 rotates by a reference angle or more and then rotates again in the closing direction in a state where the bush rod 27 is stopped at the door opening position.

According to the present embodiment, if it is determined that the opening of the door is detected by the door opening sensor 40 even before a predetermined time has elapsed in a state where the push rod 27 is positioned in the door opening position, the push rod 27 and/or the gear are prevented from being damaged by the controller 20 rotating the motor 261 in the other direction so that the push rod 27 returns to the initial direction.

If it is determined in step S12 that the door opening detection unit 40 has not detected the opening of the door, the controller 20 determines that the door has been opened, It is possible to determine whether or not a predetermined time has elapsed after the push rod 27 reaches in the door opening position or the motor 261 is stopped (S13).

In a case where predetermined time has elapsed after the push rod 27 reaches the door opening position, the controller 20 controls the motor 261 so that the motor 261 rotates in the other direction in order to return the push rod 27 to the initial position. (S14).

While the motor 261 is rotating in the other direction, the controller 20 can determine whether the push rod 27 has reached the initial position (S15).

If it is determined that the push rod 27 reaches the initial position, the controller 20 can stop the motor 261 (S16).

In the above embodiment, the door open detecting unit includes the magnetic sensor and the magnet. Alternatively, the door open detecting portion may include the optical sensor.

As an example, the optical sensor may include a light emitting portion provided in one of the hinge assembly and the first refrigerating compartment door, and a light receiving portion provided in another one of the hinge assembly and the first refrigerating compartment door. When the first refrigerating compartment door is rotated by a reference angle, the light emitted from the light emitting portion reaches the light receiving portion. The controller can control the motor so that the push rod can return to the initial position when the light reaches the light receiving portion.

Alternatively, the light emitting portion and the light receiving portion may include in any one of the hinge assembly and the first refrigerating compartment door, and the other may include a reflection plate. When the first refrigerating compartment door is rotated by the reference angle, the light emitted from the light emitting portion can be reflected by the reflection plate to reach the light receiving portion. When the light reaches the light receiving portion, the controller can control the motor such that the push rod returns to the initial position.

Further, in the above embodiment, the position detecting portion detects the position of the push rod and controls the motor based on the position of the push rod. Alternatively, the operation of the motor can be controlled based on the operation time of the motor. For example, if the motor is operated for opening the door and the first reference time has elapsed, the motor can be stopped. Further, the motor is operated so that the push rod returns to the initial position and the motor can also be stopped in a case where the second reference time has elapsed.

Figure 13:
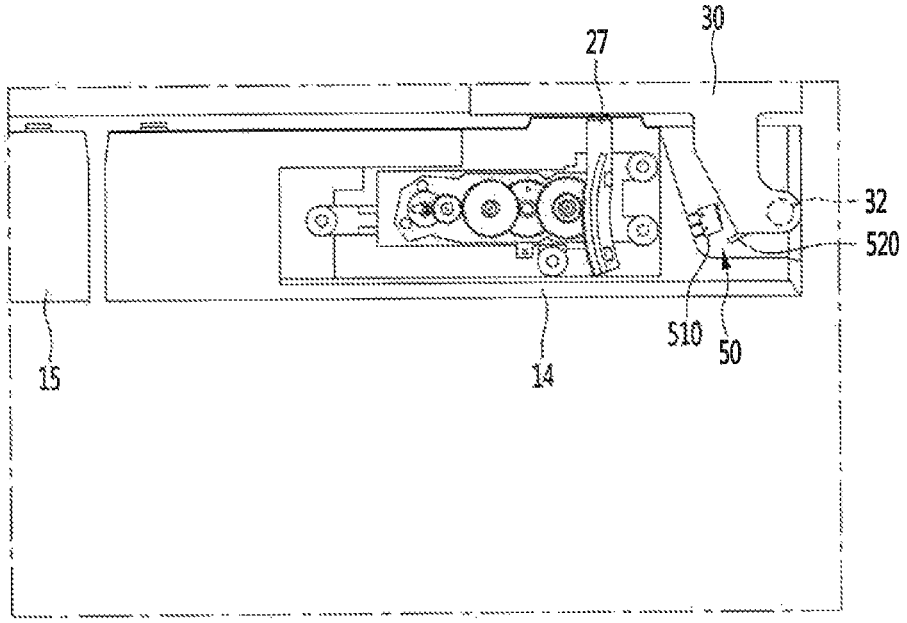
FIG. 13 is a view showing a state where the first refrigerator door according to the second embodiment of the present invention is closed.
Figure 14:
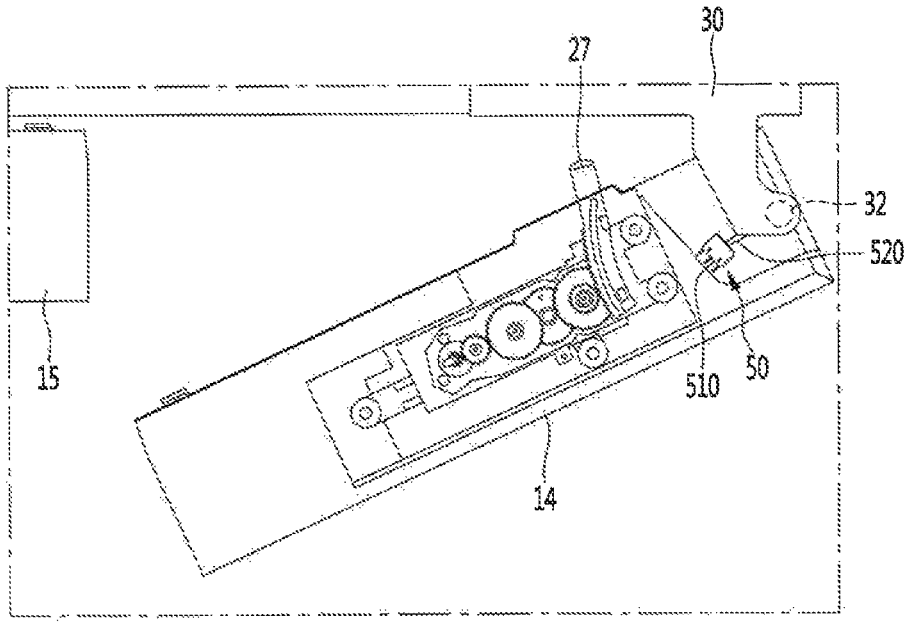
FIG. 14 is a view showing a state where the door opening detecting portion according to the second embodiment of the present invention detects the opening of the first refrigerator door.

FIG. 13 is a view showing a state where the first refrigerator door according to the second embodiment of the present invention is closed and FIG. 14 is a view showing a state where the door opening detecting portion according to the second embodiment of the present invention detects the opening of the first refrigerator door.

The present embodiment is the same as the first embodiment in other portions, but differs in the door opening detecting portion. Therefore, only the characteristic parts of this embodiment will be described below.

With reference to FIG. 13 and FIG. 14, the door opening detecting portion 50 according to the second embodiment of the present invention includes a micro switch 510 which is turned on when it is rotated by a reference angle of the first refrigerating compartment door 14.

The micro switch 510 may be installed in any one of the hinge assembly 30 and the first refrigerating compartment door 14.

The door opening detecting portion 50 is provided on the other of the hinge assembly 30 and the first refrigerating compartment door 14. When the first refrigerating compartment door 14 is rotated by a reference angle, a switch operating unit 520 for turning on the micro switch 510 is further provided.

According to the arrangement of the micro switch 510 and the switch operating unit 520, when the first refrigerating compartment door 14 is rotated below the reference angle, the micro switch 510 is kept off, when the micro switch 510 is rotated over the reference angle, the micro switch 510 can be kept turned on by the switch operating unit 520.

When the first refrigerating compartment door 14 is rotated below the reference angle of according to the arrangement of the micro switch 510 and the switch operating unit 520, the micro switch 510 is kept off. When the micro switch 510 is rotated by the reference angle and the micro switch 510 can be turned on by the switch operating part 520 and the micro switch 510 is rotated beyond the virtual reference angle, the micro switch 510 can be turned off.

In either case, the micro switch 510 may be turned on when the first refrigerating compartment door 14 is rotated by a predetermined angle. When the on state of the micro switch 510 is detected, the controller 20 controls the motor 261 in order to return the push rod 27 to the initial position while moving to the door opening position or in a state of stopping at the door opening position.

In this embodiment, the micro switch 510 may be disposed at a position adjacent to the hinge shaft 32.

In a case where the micro switch 510 is disposed in the first refrigerating compartment door 14, when the first refrigerating compartment door 14 is rotated about the hinge shaft 32, since the rotating radius of the micro switch 510 is short, the length of the switch operating unit 520 can be minimized.

In a case where the micro switch 510 is disposed in the virtual key hinge assembly 30, the switch operating portion 520 can be positioned in contact with the hinge shaft 32. In this case, when the first refrigerating compartment door 14 is rotated around the hinge shaft 32, the length of the switch operating portion 520 can be minimized since the rotating radius of the switch operating portion 520 is.

In addition, according to the present embodiment, since the micro switch 510 turned on when the first refrigerating compartment door 14 is rotated by more than a predetermined angle, it is possible to accurately detect that the first refrigerating compartment door 14 is rotated by more than the reference angle.

In addition, since the micro switch 510 and the switch operating unit 520 are positioned to be adjacent to the imaginary key hinge shaft 32, door opening can be detected without interfering with other peripheral structures.

Figure 15:
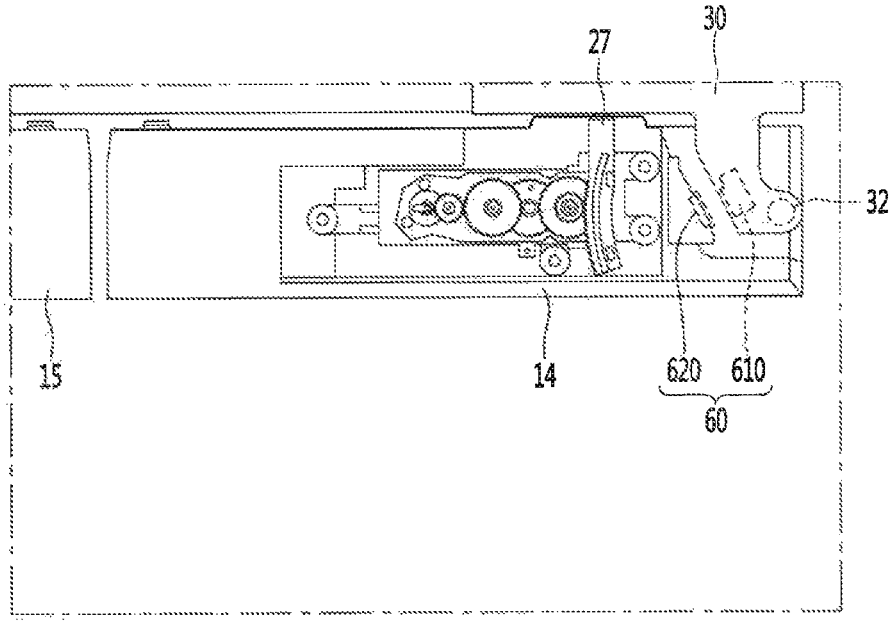
FIG. 15 is a view showing a state where the first refrigerator door according to a third embodiment of the present invention is closed.
Figure 16:
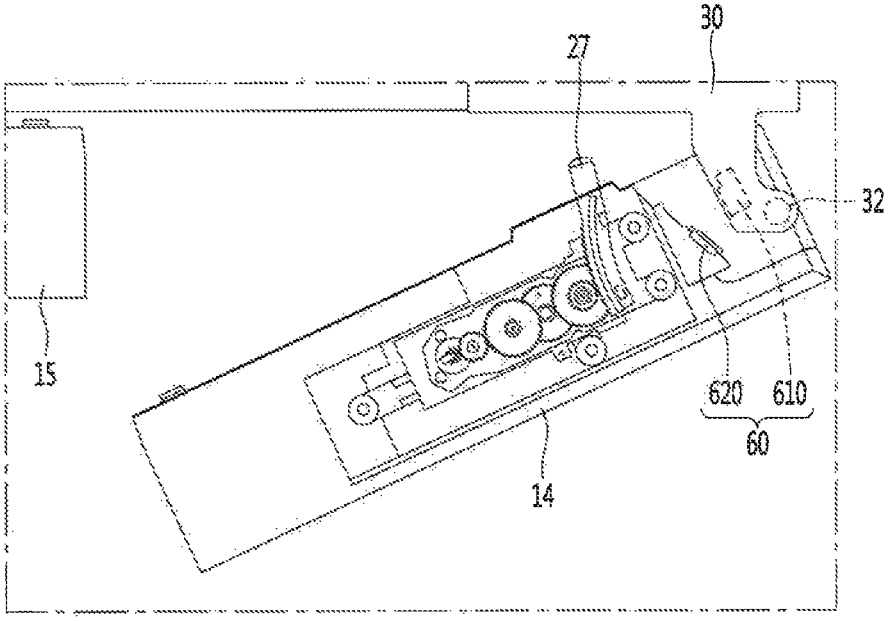
FIG. 16 is a view showing a state where the door opening detecting portion according to the third embodiment of the present invention detects the opening of the first refrigerator door.

FIG. 15 is a view showing a state where the first refrigerator door according to a third embodiment of the present invention is closed, and FIG. 16 is a view showing a state where the door opening detecting portion according to the third embodiment of the present invention detects the opening of the first refrigerator door.

The present embodiment is the same as the first embodiment in the other parts, but there is a difference in the door opening detecting part. Therefore, only the characteristic parts of this embodiment will be described below.

With reference to FIG. 15 and FIG. 16, the door opening detecting portion 60 according to the third embodiment of the present invention includes a magnet sensor 610 that is turned off when it is rotated by a predetermined angle of the first refrigerating compartment door 14, and a magnet 620 capable of providing a magnetic force to the magnet sensor 610.

The magnetic sensor 610 is a sensor that is turned on by the contact points connected to each other in a state where a magnetic force of a predetermined magnitude acts and that is turned off by the contact points separated from each other when a magnetic force less than a certain magnitude acts and may be a known sensor and thud the detailed description will be omitted.

The magnet sensor 610 can be installed in any one the hinge assembly 30 and the first refrigerating compartment door 14 and the magnet 620 can be installed in the other one of the hinge assembly 30 and the first refrigerating compartment door 14.

At this time, the magnet sensor 610 is maintained in a on state by the magnetic force of the magnet 620 when the first refrigerating compartment door 14 is rotated at a lower angle than the first refrigerating compartment door 14, The magnet sensor 610 can be turned off.

The magnet sensor 610 and the magnetic sensor 610 may be turned off only when the first refrigerating compartment door 14 is rotated at a reference angle or more even if the magnitude of the magnetic force of the magnet 620 is not large. The magnet 620 and the magnet sensor 620 may be positioned to be adjacent to the hinge shaft 32.

In addition, since the magnet sensor 610 and the magnet 620 are positioned to be adjacent to contact with the hinge shaft 32, door opening can be detected without interfering with other peripheral structures.

In the above embodiments, a magnetic sensor, a micro switch, an optical sensor, and magnet sensor may collectively be referred to as a sensor that outputs a corresponding signal when the refrigerator door is rotated over a reference angle.

Figure 17:
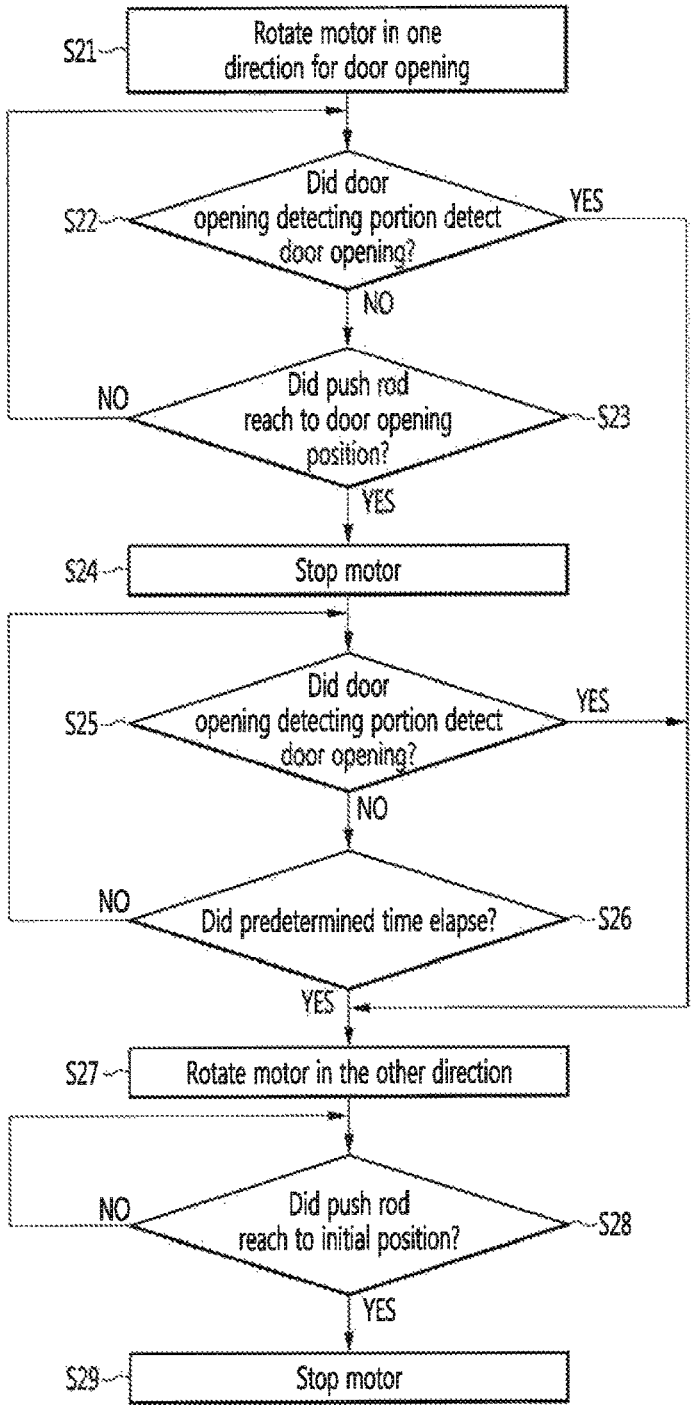
FIG. 17 is a flow chart for explaining an operation of the door opening device according to a fourth embodiment of the present invention.

FIG. 17 is a flow chart for explaining an operation of the door opening device according to a fourth embodiment of the present invention.

The present embodiment is similar to the first embodiment in other respects, but suggests a control method of the door opening device that is simpler than the control method of the door opening device of the first embodiment. Therefore, only the characteristic parts of this embodiment will be described below.

Referring to FIG. 17, the push rod 27 may be positioned at an initial position when the first refrigerating compartment door 14 closes the refrigerating compartment 111. At this initial position, the position sensor 281 is detecting the seat 275 of the seat push rod 27.

The push rod 27 may be in contact with the front surface of the cabinet 11 or may be separated from the front surface of the cabinet 11 in a state where the push rod 27 is positioned at the initial position.

If it is determined that the door open signal has been input, the controller 20 controls the motor 261 to rotate the motor 261 in one direction (S21).

When the motor 261 rotates in one direction of the arrow 262, the plurality of gears 262, 263, 262, 265, and 266 are rotated in the forward direction and the push rod 27 pushed the cabinet 11, 14, and as reaction to this the first refrigerating compartment door 14 is rotated.

During the rotation of the motor 261 in one direction, the controller 20 determines whether the door opening detecting portion 40 detects the door opening (S22).

In this specification, a case where the door opening detection unit 40 detects the door opening while the motor 261 is being rotated in one direction is a case the first refrigerating compartment door 14 is rotated in the direction in which first refrigerating compartment door 14 is opened by user.

The opening angle (θ2) of the first refrigerating compartment door 14 when the door opening detecting portion 40 detects the opening of the door is larger than the opening angle (θ1) of the first refrigerating compartment door 14 when the push rod 27 is moved to the opening position.

When the refrigerating compartment door 14 is rotated over the reference angle in the process of the first refrigerating compartment door 14 being rotated to be opened the door opening sensor 40 detects the opening of the door.

In this embodiment, in order to prevent the push rod 27 and/or the gears which constitutes the power transmission mechanism from being damaged by the first refrigerating compartment door 14 being opened and then closed by a user while the motor 261 is being rotated in one direction, in a case where the door opening is detected at the door opening detecting portion 40, the controller 20 causes the motor 261 to rotate in the other direction so that the push rod 27 returns to the initial position (S27).

According to the present embodiment, in a case where the door opening detecting portion 40 detects the door opening in a process of the push rod 27 moving from the initial position to the door opening position by the motor 261 operating in one direction, the push rod 27 is capable of being returned to the initial direction by the motor 261 being rotated in the other direction before the push rod 27 is moved to the door opening position.

Therefore, since the push rod 27 is moved to the initial position in the process of rotating in the closed direction after the rotation of the first refrigerating compartment door 14 by the reference angle or more. The push rod 27 and the cabinet 11 can be prevented from being damaged by the impact of the push rod and the gears.

Meanwhile, in a case where it is determined in step S22 that door opening is not detected in the door opening detecting portion 40 while the motor 261 is rotating in one direction, the controller 20 is capable of determining whether or not the push rod 27 reaches the door opening position (S3).

In other words, when the motor 261 is rotated in the direction in which the push rod 27 is positioned at the initial position, the push rod 27 is moved in a curved line. In this process, the first position sensor 281 The push rod 27 is detected by the second position sensor 282 in the course of the curved movement of the push rod 27. In this case, The controller 20 can determine that the push rod 27 reaches the door opening position.

If it is determined in step S23 that the push rod 27 reaches the door opening position, the controller 20 stops the motor 261 (S24).

Meanwhile, as in FIG. 11 (*d*), in a state where the push rod 27 reaches the door opening device, at least a part of the rear surface 14*c* of the first refrigerating compartment door 14 may be positioned in the front side of the front surface 15*a* of the second refrigerating compartment door 15.

Therefore, there is a gap G between an edge 14*d* of side which is adjacent to the second refrigerating compartment door 15 in the rear surface 14*c* of the first refrigerating compartment door 14 and an edge 15*b* of side which is adjacent to the first refrigerating compartment door 14 in the front surface 15*a* of the second refrigerating compartment door 15.

The gap G may be set to a degree to which the user's elbow or foot can be inserted in the case where both hands of the user are not free.

Therefore, in a case where the first refrigerating compartment door 14 is rotated by the opening angle (θ1), the user inserts the elbow or the foot into the gap G to manually increase the opening angle of the first refrigerating compartment door 14.

Meanwhile, in a state where the push rod 27 reaches the final position and the motor 261 is stopped, the controller 20 can determine whether or not the door opening detecting portion 40 detects the door opening (S25).

In case where the door opening detection unit 40 detects the door opening in a state where the push rod 27 reaches the door opening position is a case where the opening angle of the first refrigerating compartment door 14 is increased by a user.

As described above, the opening angle (θ1) of the first refrigerating compartment door 14 in the state in which the push rod 27 reaches the door opening position is smaller than the opening angle (θ2) of the first refrigerating compartment door 14 when the door opening detecting portion 40 detects the opening of the first refrigerating compartment door 14.

Accordingly, when the opening angle of the first refrigerating compartment door 14 is increased in a state where the push rod 27 reaches the door opening position, the door opening detecting portion 40 detects the door opening.

If it is determined in step S25 that the door opening detecting portion 40 detects the opening of the door, the controller 20 can rotate the motor 261 in the other direction so that the push rod 27 returns to the initial position (S27).

The push rod 27 and/or the gear can be damaged even if the first refrigerating compartment door 14 rotates by a reference angle or more and then rotates again in the closing direction in a state where the push rod 27 is stopped at the door opening position.

According to the present embodiment, if it is determined that the opening of the door is detected by the door opening sensor 40 even before a predetermined time has elapsed in a state where the push rod 27 is positioned in the door opening position, the push rod 27 and/or the gear are prevented from being damaged by the controller 20 rotating the motor 261 in the other direction so that the push rod 27 returns to the initial direction.

If it is determined in step S25 that the door opening detection unit 40 has not detected the opening of the door, the controller 20 determines that the door has been opened, It is possible to determine whether or not a predetermined time has elapsed after the push rod 27 reaches in the door opening position or the motor 261 is stopped (S26).

In a case where predetermined time has elapsed after the push rod 27 reaches the door opening position, the controller 20 controls the motor 261 so that the motor 261 rotates in the other direction in order to return the push rod 27 to the initial position. (S27).

While the motor 261 is rotating in the other direction, the controller 20 may determine whether the push rod 27 has reached the initial position (S28).

If it is determined that the push rod 27 reaches the initial position, the controller 20 may stop the motor 261 (S29).

The invention claimed is:

1. A refrigerator, comprising:

a cabinet in which a storage compartment is formed;

a first refrigerator door that is configured to open and close the storage compartment;

a second refrigerator door that is disposed along with the first refrigerator door in a lateral direction; and a door opening device that is configured to open and close at least one of the first refrigerator door and the second refrigerator door, wherein the door opening device is provided on the one refrigerator door, the door opening device includes:

a motor that is configured to generate a driving force;

a push rod that is configured to receive the driving force generated by the motor;

a gear that is configured to transfer the driving force of the motor to the push rod, wherein the push rod is configured to move from an initial position to a door opening position when the motor opens the one refrigerator door of the first refrigerator door and the second refrigerator door, wherein the push rod is configured to be in contact with a front surface of the cabinet when moving from the initial position to the door opening position, and wherein at least a portion of the rear surface of the one refrigerator door is positioned on the front side of the front surface of the other refrigerator door of first refrigerator door and the second refrigerator door when the push rod is moved to the door opening position.

2. The refrigerator according to claim 1, wherein the door opening device is positioned on the upper side portion of the one refrigerator door.

3. The refrigerator according to claim 2, wherein the push rod maintains a state of being in contact with a point of the front surface of the cabinet when moving from the initial position to the door opening position.

4. The refrigerator according to claim 1, wherein the push rod includes a rack gear that is configured to engage with a gear and has a curved shape.

5. The refrigerator according to claim 4, wherein the rack gear is formed in an arc shape.

6. The refrigerator according to claim 1, wherein the one refrigerator door includes a first side surface and a second side surface facing the first side surface, wherein the second side surface is a surface which is adjacent to the other refrigerator door of the first refrigerator door and the second refrigerator door, wherein a virtual line bisects the interval between the first side surface and the second side surface, and wherein a hinge shaft of the one refrigerator door and the push rod is positioned on the area which corresponds to between the virtual line, which bisects the interval between the first side surface and the second side surface, and the first side surface.

7. The refrigerator according to the claim 6, wherein the push rod is positioned in the area between the virtual line and the hinge shaft.

* * * * *